US010634363B2

(12) United States Patent
Gomez et al.

(10) Patent No.: US 10,634,363 B2
(45) Date of Patent: Apr. 28, 2020

(54) SPRING BRACKET FOR A COOKTOP APPLIANCE

(71) Applicant: Haier US Appliance Solutions, Inc., Wilmington, DE (US)

(72) Inventors: Eugenio Gomez, Louisville, KY (US); Gregory Michael Thomas, Louisville, KY (US); Howard Richard Bowles, Louisville, KY (US); Kalakuntla Sagar Rao, Louisville, KY (US); Eduardo Miguel Paz Calvopina, Santiago de Queretaro (MX)

(73) Assignee: Haier US Appliance Solutions, Inc., Wilmington, DE (US)

( * ) Notice: Subject to any disclaimer, the term of this patent is extended or adjusted under 35 U.S.C. 154(b) by 284 days.

(21) Appl. No.: 15/786,649

(22) Filed: Oct. 18, 2017

(65) Prior Publication Data

US 2019/0113238 A1 Apr. 18, 2019

(51) Int. Cl.

| | |
|---|---|
| ***F24C 7/06*** | (2006.01) |
| ***H05B 3/74*** | (2006.01) |
| ***F24C 15/10*** | (2006.01) |
| ***H01H 37/04*** | (2006.01) |

(52) U.S. Cl.

CPC ..... *F24C 7/067* (2013.01); *F24C 15/105* (2013.01); *H01H 37/043* (2013.01); *H05B 3/748* (2013.01); *F24C 15/102* (2013.01); *F24C 15/103* (2013.01)

(58) Field of Classification Search

CPC ..... F24C 7/067; F24C 15/105; F24C 15/103; H05B 3/748; H01H 37/043

USPC ..... 219/212, 252, 447.1, 448.14, 465.1, 497

See application file for complete search history.

(56) References Cited

U.S. PATENT DOCUMENTS

| | | | | |
|---|---|---|---|---|
| 4,812,624 | A | 3/1989 | Kern | |
| 6,753,509 | B2 | 6/2004 | Gratz et al. | |
| 2003/0019863 | A1* | 1/2003 | Gratz | H05B 3/746 219/448.17 |
| 2018/0238559 | A1* | 8/2018 | Pasqual | H05B 3/76 |

FOREIGN PATENT DOCUMENTS

| | | |
|---|---|---|
| GB | 2414559 B | 8/2007 |

* cited by examiner

*Primary Examiner* — Thien S Tran

(74) *Attorney, Agent, or Firm* — Dority & Manning, P.A.

(57) ABSTRACT

A low profile spring bracket for a heating element of a cooktop appliance includes features that allow the bracket to move along the axial direction in a smooth fashion with minimal force. In this way, a temperature sensor attached thereto can maintain contact with a cooking utensil placed on the heating element.

18 Claims, 10 Drawing Sheets

SPRING BRACKET FOR A COOKTOP APPLIANCE

FIELD OF THE INVENTION

The present subject matter relates generally to cooktop appliances, and more particularly to spring brackets for heating elements of cooktop appliances.

BACKGROUND OF THE INVENTION

Cooking appliances, such as e.g., cooktops or ranges (also known as hobs or stoves), generally include one or more heating elements for heating or cooking food items within a cooking utensil placed on the heating element. The heating elements utilize one or more heating sources to output heat, which is transferred to the cooking utensil and to any food item or items within the cooking utensil.

Certain cooktop appliances include temperature sensors for sensing the surface temperature of cooking utensils placed on one of the heating elements. Excessive surface temperatures of cooking utensils may cause the food items or cooking utensil to overheat or otherwise cause unwanted and/or unsafe conditions on the cooktop. Thus, in some instances, it may be desirable to limit the surface temperature of cooking utensils placed on heating elements of the cooktop. Temperature sensors can sense the surface temperature of the cooking utensil and relay the sensed temperature to a controller such that the temperature can be adjusted if necessary.

Certain conventional cooktop appliances include spring-loaded temperature sensors configured to contact the underside of a cooking utensil placed on a heating element of the cooktop appliance. Placing the spring-loaded temperature sensor below the cooking utensil presents certain challenges. For example, in some instances, light weight cooking utensils (e.g., aluminum pots and pans) are not heavy enough to force the spring-loaded temperature sensor downward due to the high spring rate of the spring of the spring-loaded temperature sensor. As such, the spring-loaded temperature sensor acts as a high point and prevents the cooking utensil from sitting properly on the heating element. As a result, the cooking utensil becomes tilted. As another example, some conventional spring-loaded temperature sensors have vertically oriented profiles that can take up a considerable amount of vertical space below the heating element. While these designs are able to offer spring-loaded temperature sensors with lower spring constants, the vertical orientation of such designs constrains the design of the cooktop appliance and requires valuable space. Moreover, some conventional spring-loaded temperatures sensors include springs that are difficult to connect with or attach to one or more components of the cooktop appliance. For example, coil springs can be difficult to weld to components of the cooktop appliance as they have spiral shapes and minimal surface area available for welding.

Accordingly, a spring bracket with a temperature sensor mounted thereto for a heating element of a cooktop appliance that solves one or more of the challenges noted above would be desirable.

BRIEF DESCRIPTION OF THE INVENTION

The present disclosure provides a low profile spring bracket for a heating element of a cooktop appliance that includes features that allow the bracket to move along the axial direction in a smooth fashion with minimal force. In this way, a temperature sensor attached to the spring bracket can maintain contact with a cooking utensil placed on the heating element. Aspects and advantages of the invention will be set forth in part in the following description, or may be obvious from the description, or may be learned through practice of the invention.

In one exemplary embodiment, a spring bracket for a cooktop appliance is provided. The cooktop appliance includes a heating element and a support bracket for supporting the heating element. The spring bracket defines an axial direction, a radial direction, and a circumferential direction. The spring bracket includes a mounting plate moveable along the axial direction. The spring bracket also includes a first arm extending from the mounting plate between a proximal end and a distal end and connecting the mounting plate with the support bracket, wherein the first arm comprises a curved portion that extends about the circumferential direction along at least a portion of the first arm between the proximal end and the distal end of the first arm. The spring bracket further includes a second arm extending from the mounting plate between a proximal end and a distal end and connecting the mounting plate with the support bracket, wherein the second arm comprises a curved portion that extends about the circumferential direction along at least a portion of the second arm between the proximal end and the distal end of the second arm.

In another exemplary embodiment, a cooktop appliance is provided. The cooktop appliance includes a heating element and a support bracket for supporting the heating element. The cooktop appliance also includes a spring bracket defining an axial direction, a radial direction, and a circumferential direction. The spring bracket also includes a mounting plate moveable along the axial direction in response to a load placed on the heating element and having a temperature sensor mounted thereto. The cooktop appliance also includes one or more arms extending from the mounting plate between a proximal end and a distal end and connecting the mounting plate with the support bracket, wherein the one or more arms extend about the mounting plate along the circumferential direction and are spaced apart from the mounting plate along the radial direction as the one more arms extend about the mounting plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
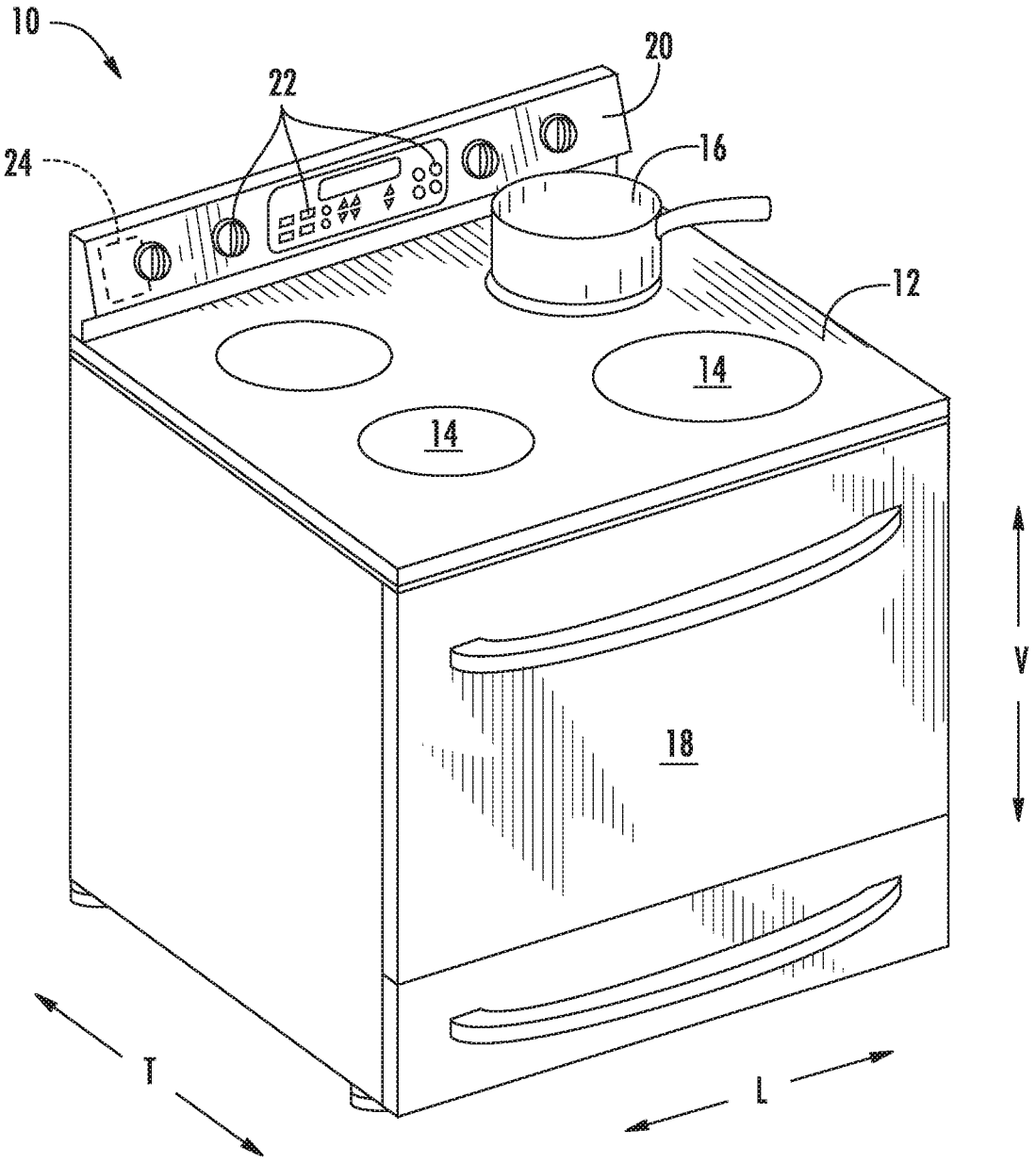
FIG. 1 provides a perspective view of a cooktop appliance according to various exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. The term "about", when used to describe angular position, means within ten degrees (10°) of the stated angular position. The term "substantially" means within ten percent of the stated value.

FIG. 1 provides a perspective view of an exemplary cooktop appliance 10. Generally, cooktop appliance 10 defines a vertical direction V, a lateral direction L, and a transverse direction T. The vertical direction V, lateral direction L, and transverse direction T are mutually perpendicular and form an orthogonal direction system. As illustrated in FIG. 1, cooktop appliance 10 may be a range appliance that includes a horizontal cooking surface, such as a top panel 12, disposed on and/or vertically above an oven cabinet. However, cooktop appliance 10 is provided by way of example and is not intended to limit the present subject matter to any particular appliance or cooktop arrangement. Thus, the present subject matter may be used with other cooktop appliance configurations, e.g., cooktop appliances without an oven. Further, the present subject matter may be used in other suitable types of appliances.

Top panel 12 may be constructed of any suitable material, e.g., a ceramic, enameled steel, or stainless steel. As shown in FIG. 1, top panel 12 of cooktop appliance 10 includes one or more heating assemblies 14. A cooking utensil 16 is shown placed or positioned on one of the heating assemblies 14 to cook or heat food items placed within cooking utensil 16. Cooking utensil 16 can be any suitable type of utensil, including e.g., pots, kettles, pans, skillets, or the like. For this embodiment, cooktop appliance 10 includes a door 18 that permits access to a cooking chamber (not labeled) of the oven cabinet of cooktop appliance 10. The cooking chamber is configured for cooking or baking food or other items placed therein.

Cooktop appliance 10 includes a user interface 20 having one or more control inputs 22 that permit a user to make selections for cooking of food items using heating assemblies 14 and/or the cooking chamber. As an example, a user may manipulate one or more control inputs 22 to select, e.g., a power or heat output setting for each heating assembly 14. The selected heat output setting of heating assembly 14 affects the heat transferred to cooking utensil 16 positioned on heating assembly 14. Although shown on a backsplash or back panel of cooktop appliance 10, user interface 20 may be positioned in any suitable location, e.g., along a front edge of the appliance 10. Control inputs 22 may include one or more buttons, knobs, or touch screens, as well as combinations thereof.

Cooktop appliance 10 also includes a controller 24 operably connected, e.g., electrically coupled, to user interface 20 and/or control inputs 22. Generally, operation of cooktop appliance 10, including heating assemblies 14, may be controlled by controller 24. In some embodiments, controller 24 is a processing device and may include a microprocessor or other device that is in operable communication with components of cooktop appliance 10, such as heating assembly 14. Controller 24 may include a memory and microprocessor, such as a general or special purpose microprocessor operable to execute programming instructions or micro-control code associated with a selected heating level, operation, or cooking cycle. The memory may represent random access memory such as DRAM, and/or read only memory such as ROM or FLASH. In some embodiments, the processor executes programming instructions stored in memory. The memory may be a separate component from the processor or may be included onboard within the processor.

Alternatively, controller 24 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control inputs 22 and other components of cooktop appliance 10 may be in communication with (e.g., electrically coupled to) controller 24 via one or more signal lines or shared communication busses.

Operation of heating assemblies 14 may be regulated such that the temperature or heat output of heating assembly 14 corresponds to a temperature or heat output selected by a user of cooktop appliance 10. In this regard, for example, a user of cooktop appliance 10 may, e.g., manipulate a control 22 associated with a heating assembly 14 to select a desired heat output or temperature.

In some embodiments, it may be desirable to control the surface temperature of cooking utensils 16 placed on one of heating assemblies 14 for safety purposes. For instance, if the surface temperature of a cooking utensil exceeds a predetermined threshold, controller 24 can reduce the heat output of the heating element of heating assembly 14 to ultimately reduce the surface temperature of the cooking utensil below the predetermined threshold. Accordingly, in some embodiments, cooktop appliance 10 includes means for sensing the temperature of cooking utensils 16 placed on heating assemblies 14.

Figure 2:
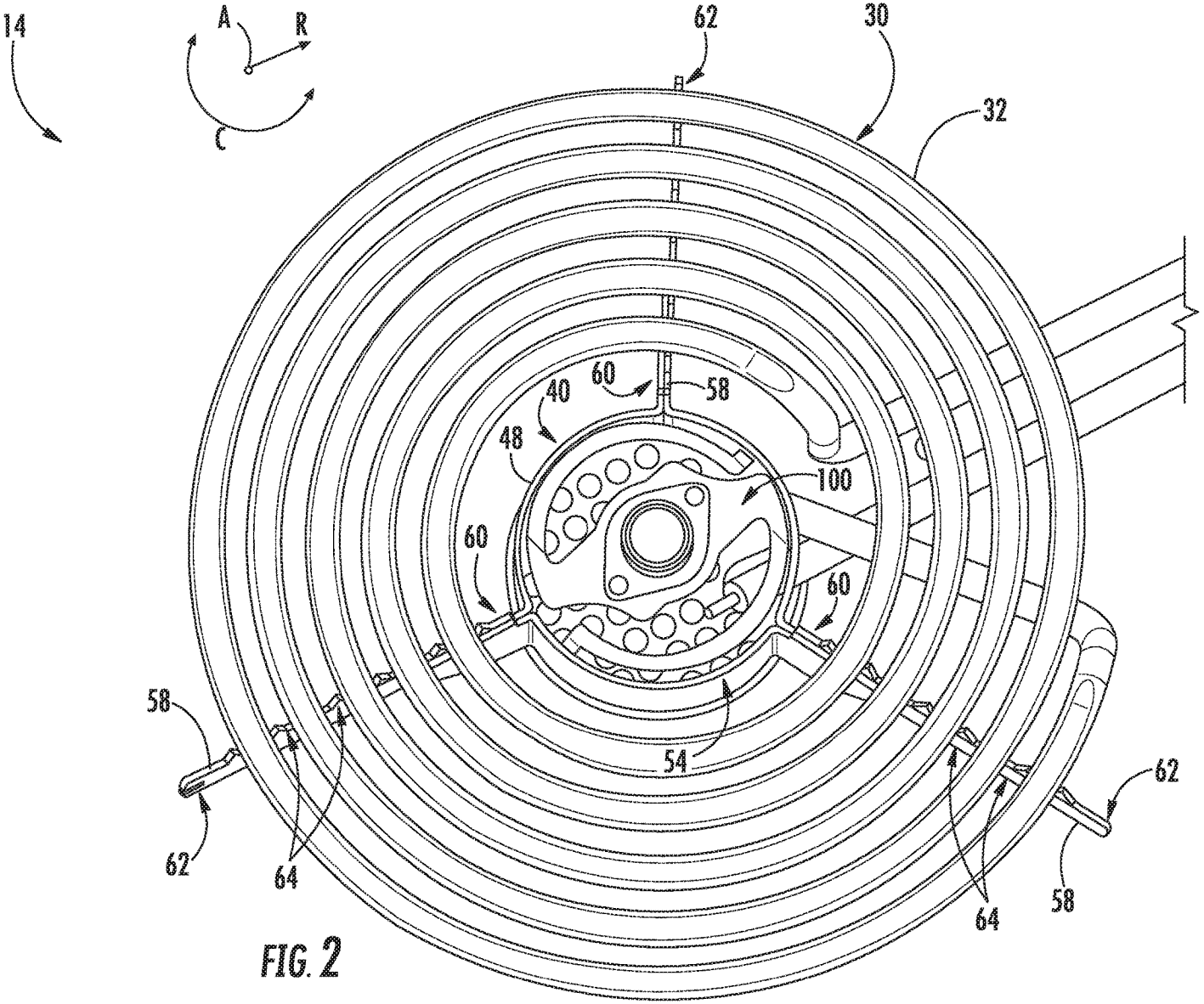
FIG. 2 provides a perspective view of an exemplary heating assembly according to various exemplary embodiments of the present disclosure.
Figure 3:
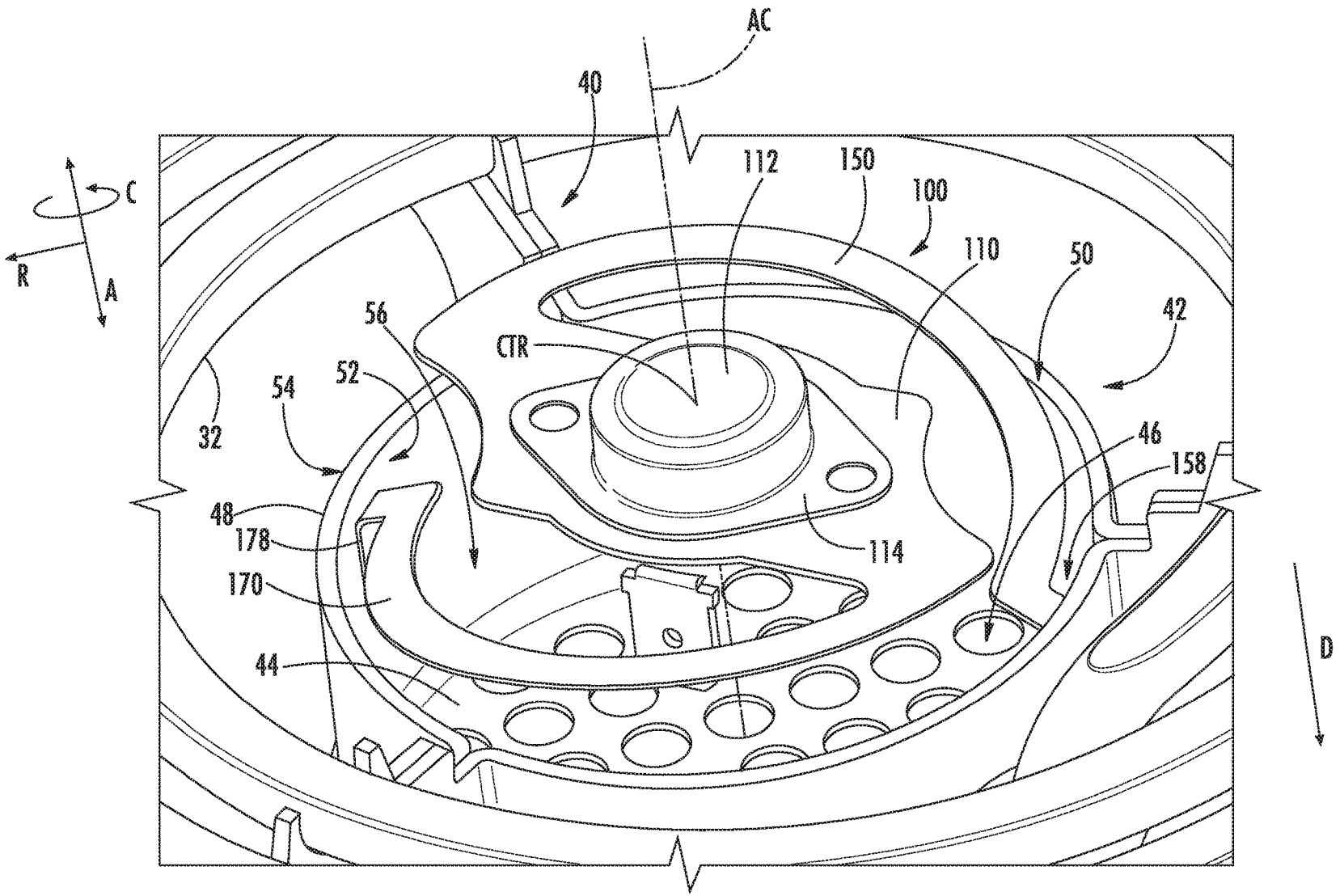
FIG. 3 provides a close up, perspective view of a spring bracket of the heating assembly of FIG. 2.

FIG. 2 provides a perspective view of an exemplary heating assembly 14 of cooktop appliance 10 of FIG. 1. FIG. 3 provides a close up perspective view of a spring bracket 100 of the heating assembly 14 of FIG. 2. As shown, heating assembly 14 defines an axial direction A, a radial direction R, and a circumferential direction C extending three hundred sixty degrees (360°) about the axial direction A. In this example, the axial direction A extends along the vertical direction V of cooktop appliance 10 (FIG. 1). Spring bracket 100 defines an axial centerline AC extending along the axial direction A through the center of spring bracket 100 (FIG. 3).

As shown in FIG. 2, heating assembly 14 includes a heating element 30. For this embodiment, heating element 30 is a spirally wound resistive electric coil 32 electrically coupled with a power source. In general, the power source passes electrical energy through electric coil 32 in a manner that generates thermal energy to transfer to cooking utensil 16 (FIG. 1). The amount of electrical energy provided may be regulated as noted above, e.g., by controller 24 (FIG. 1), to control the output of heat energy from electric coil 32. When a voltage differential is applied across the terminals of electric coil 32, the temperature of heating element 30 increases. Conversely, when the voltage differential dissipates or decreases across the terminals of electric coil 32, the temperature of heating element 30 decreases. Electric coil 32 may be a CALROD® coil, for example.

Heating element 30 illustrated in FIG. 2 is an exemplary heating element used only for the purpose of explanation and is not intended to limit the scope of the present subject matter. For instance, although heating element 30 is illustrated as including a single electric coil 32 forming a spiral shape by winding in coils around a center point, electric coil 32 may have a different number of turns, other shapes, or other configurations as well. Moreover, heating assemblies 14 may have any suitable shape, size, and number of defined heating coils, zones, and configurations. Optionally, each heating assembly 14 of cooktop appliance 10 (FIG. 1) may be heated by the same type of heating source, or cooktop appliance 10 may include a combination of different types of heating sources. Cooktop appliance 10 may include a combination of heating assemblies 14 of different shapes and sizes.

As further shown in FIG. 2, heating assembly 14 includes a spider or support bracket 40 for supporting heating element 30 within a drip pan (not shown) of cooktop appliance 10. Support bracket 40 is shown positioned generally below electric coil 32 along the axial direction A. As shown more particularly in FIG. 3, support bracket 40 includes a center member 42 that includes a bottom wall 44 extending in a plane substantially perpendicular to the axial direction A. Bottom wall 44 has a generally circular shape and defines a plurality of openings 46. Openings 46 may allow for electrical wires or other objects to be inserted therethrough. Center member 42 also includes a sidewall 48 extending from the perimeter of bottom wall 44. More particularly, sidewall 48 extends along the axial direction A circumferentially about the perimeter of bottom wall 44. Sidewall 48 extends upward along the axial direction A toward electric coil 32. Sidewall 48 also extends along the radial direction R between an inner surface 52 and an outer surface 54 to define a thickness of sidewall 48. Sidewall 48 and bottom wall 44 define a recess 56. Recess 56 provides space for various components to fit therein, such as resistive coil cold pins and wires. As will be explained more fully below, recess 56 also provides space in which spring bracket 100 can travel or move along the axial direction A when a cooking utensil is placed on electric coil 32.

As depicted in FIG. 2, support bracket 40 also includes legs or radial supports 58 extending outward from sidewall 48 along the radial direction R. For this embodiment, three radial supports 58 extend radially outward from outer surface 54 of sidewall 48 and are spaced apart equal distances from one another along the circumferential direction C. Each radial support 58 extends along the radial direction R between a proximal end 60 and a distal end 62. The proximal ends 60 of the radial supports 58 attach or connect to outer surface 54 of sidewall 48 and the distal ends 62 attach or connect to a ledge or flange of a drip pan (not shown) to support heating element 30. Moreover, radial supports 58 define notches 64 to secure segments of electric coil 32 therein.

Although center member 42 is shown in FIGS. 2 and 3 having a generally circular shape, center member 42 may have other suitable geometries, including e.g., a triangular, rectangular, pentagonal, hexagonal, heptagonal, octagonal, polygonal, or other suitable geometries. In such embodiments, it will be appreciated that center member 42 may include more than one sidewall. Moreover, support bracket 40 can include any suitable number of radial supports 58.

With reference again to FIG. 3, for this embodiment, spring bracket 100 includes a mounting plate 110 with a temperature sensor 112 mounted thereto. Temperature sensor 112 is operatively configured to sense the surface temperature of a cooking utensil placed on electric coil 32 and to provide such temperature measurements to controller 24 (FIG. 1). Temperature sensor 112 can be any suitable type of temperature sensor, such as e.g., a bimetal thermostat, a thermistor, a resistive temperature device (RTD), a thermocouple (TC), or any other suitable temperature sensing device. Temperature sensor 112 can be mounted to mounting plate 110 in a number of suitable ways. For instance, temperature sensor 112 can be welded, clipped, attached to mounting plate 110 with mechanical fasteners (e.g., screws or rivets), or a combination thereof. For this embodiment, a flange 114 of temperature sensor 112 is welded to mounting plate 110. Moreover, heating element 30, or electric coil 32 in this embodiment, defines a center CTR. In this embodiment, center CTR is positioned along the axial centerline AC. As shown in FIG. 3, temperature sensor 112 mounted to mounting plate 112 is positioned substantially in the center CTR of heating element 30.

In addition, for this embodiment, spring bracket 100 includes two arms extending from mounting plate 110 and connecting spring bracket 100 with support bracket 40. In particular, spring bracket 100 includes a first arm 150 extending from mounting plate 110 and connecting spring bracket 100 with support bracket 40 and a second arm 170 extending from mounting plate 110 and connecting spring bracket 100 with support bracket 40. First and second arms 150, 170 can connect to support bracket 40 in a number of suitable ways. For instance, first and second arms 150, 170 can be welded, snapped, clipped, or attached to support bracket 40 with mechanical fasteners (e.g., screws or rivets), or a combination thereof. Spring bracket 100 can be formed of various suitable materials. For instance, in some embodiments, spring bracket 100 is formed of a stainless steel full hard or spring tempered material. Spring bracket 100 can be formed of other suitable high yield strength materials as well.

When a cooking utensil is placed on electric coil 32, temperature sensor 112 contacts the bottom surface of the cooking utensil and the cooking utensil deflects or moves mounting plate 110 of spring bracket 100 in a downward direction D along the axial direction A (FIG. 3). In accordance with exemplary embodiments of the present subject matter, spring bracket 100 includes features that allow for temperature sensor 112 to maintain contact with the cooking utensil as the mounting plate 110 is deflected along the axial direction A. In addition, spring bracket 100 can travel or be moved along the axial direction A in such a way that cooking utensil can properly sit on electric coil 32 when placed thereon. Moreover, the geometric configuration of spring bracket 100 allows mounting plate 110 of spring bracket 100 to be moved smoothly along the axial direction A with minimal force. In this way, when a lightweight cooking utensil is placed on electric coil 32, such as e.g., an aluminum pan, the lightweight cooking utensil is able to press down and engage temperature sensor 112. The geometric configuration of exemplary embodiments of spring bracket 100 will be described in greater detail below.

Figure 4:
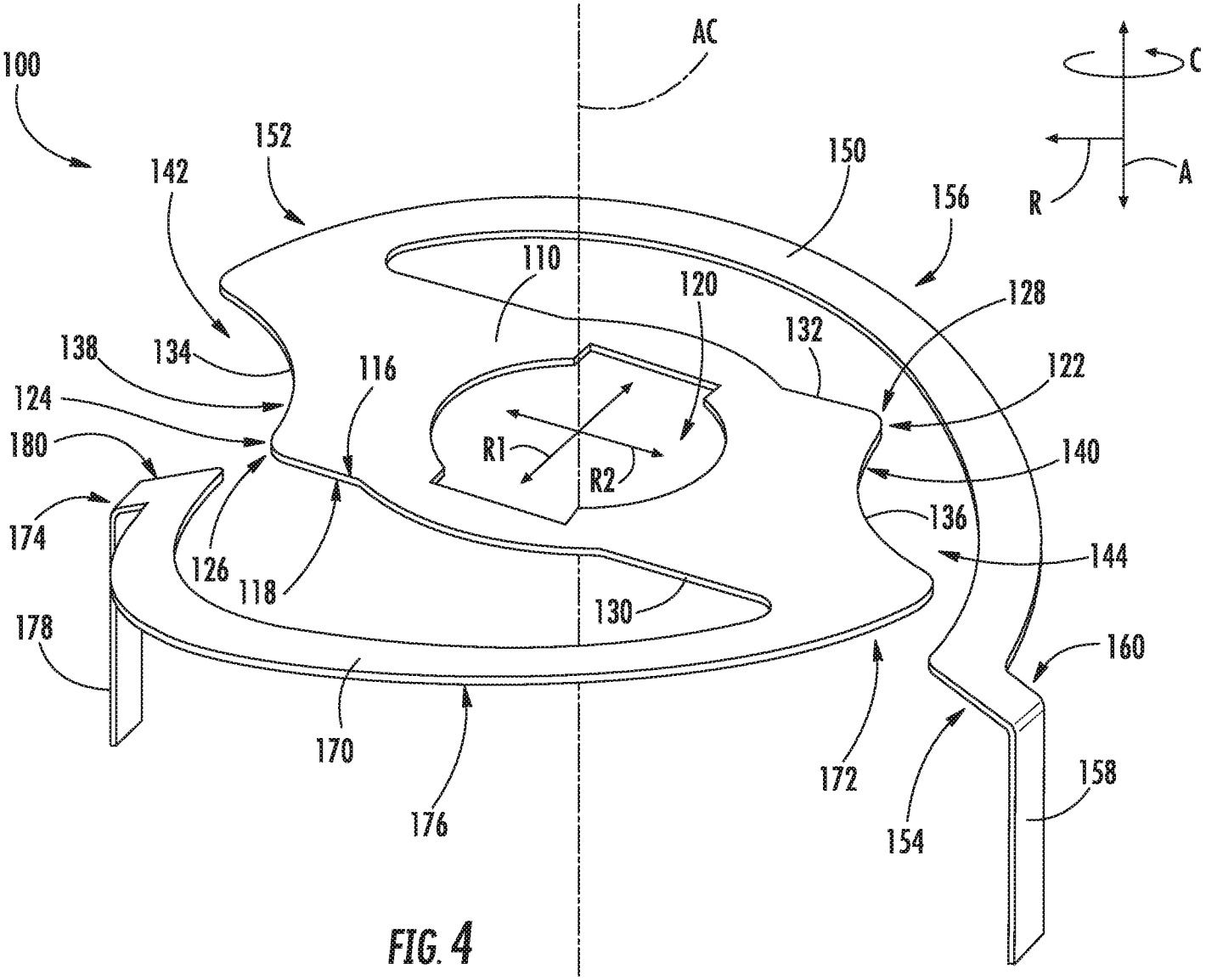
FIG. 4 provides a perspective view of an exemplary spring bracket according to various exemplary embodiments of the present disclosure.
Figure 5:
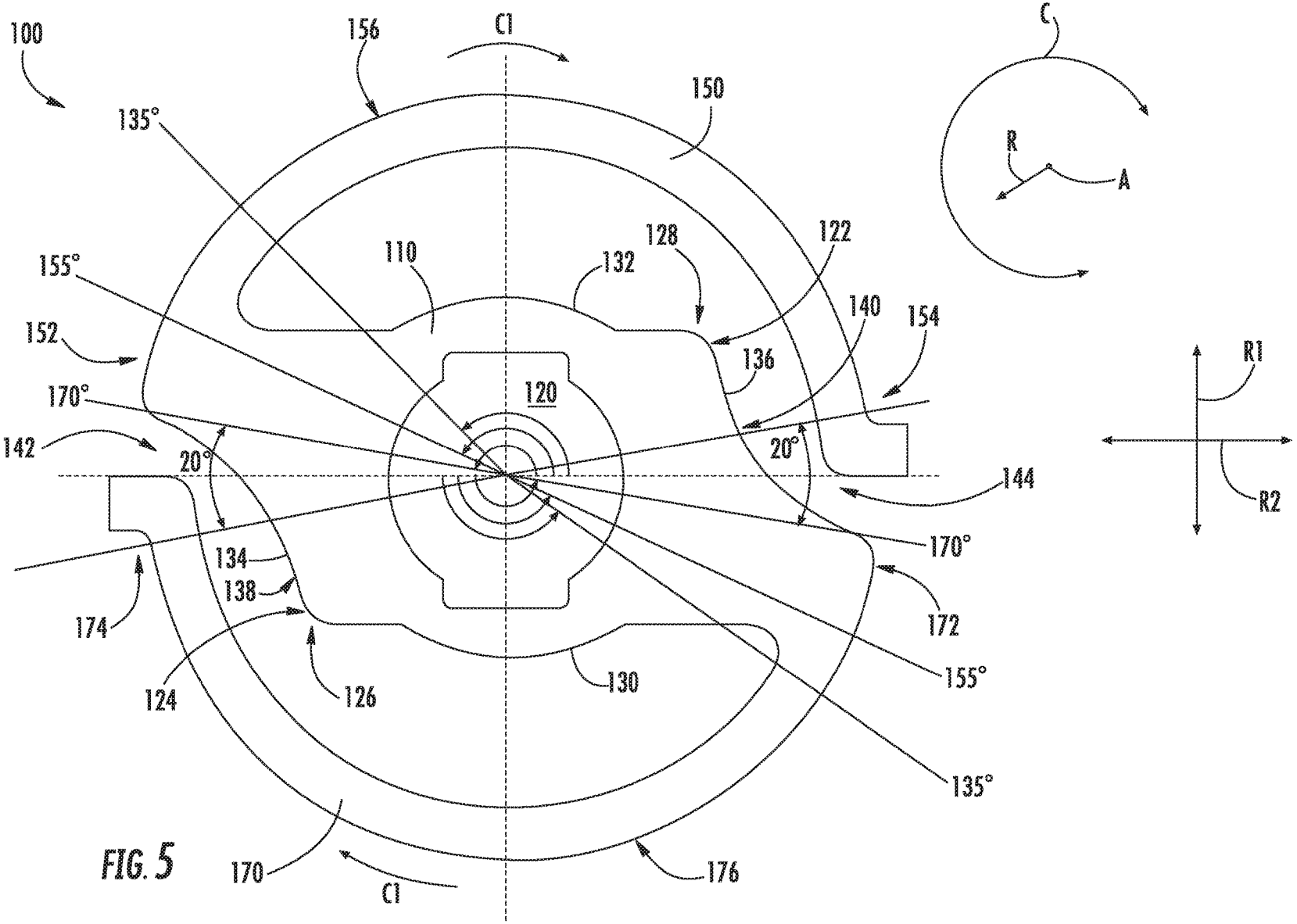
FIG. 5 provides a top plan view of the spring bracket of FIG. 3.
Figure 6:
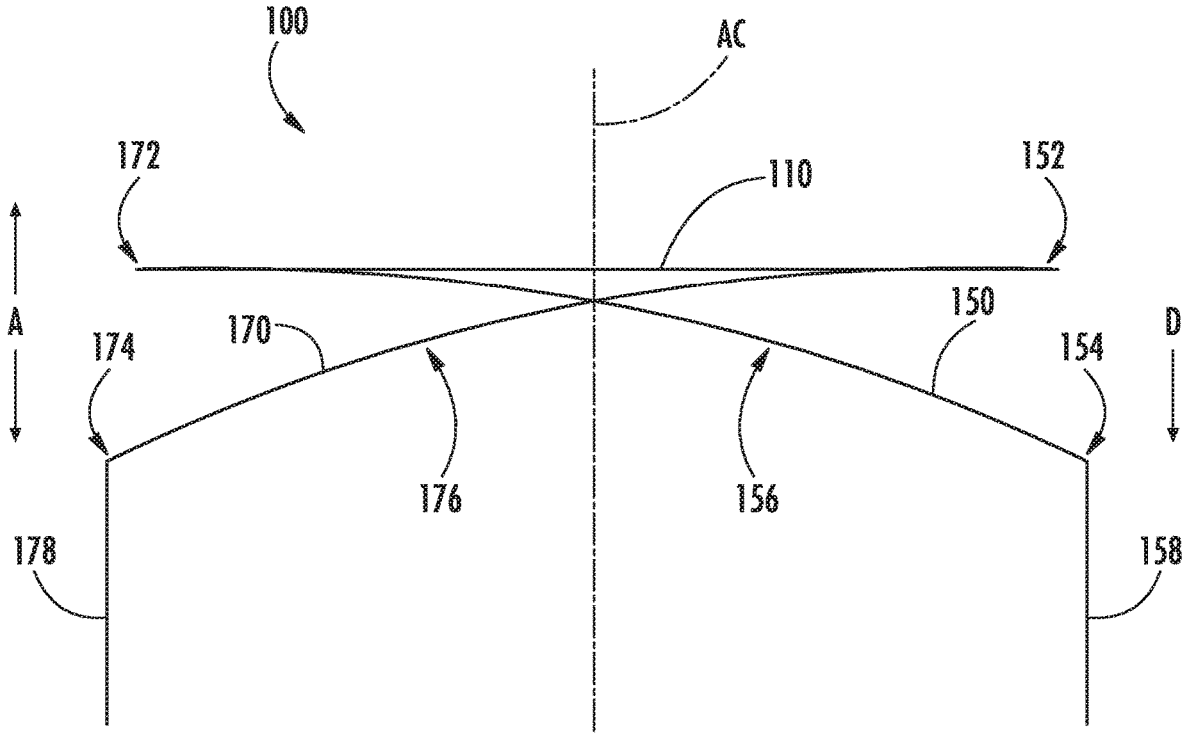
FIG. 6 provides a front elevation view of the spring bracket of FIG. 3.
Figure 7:
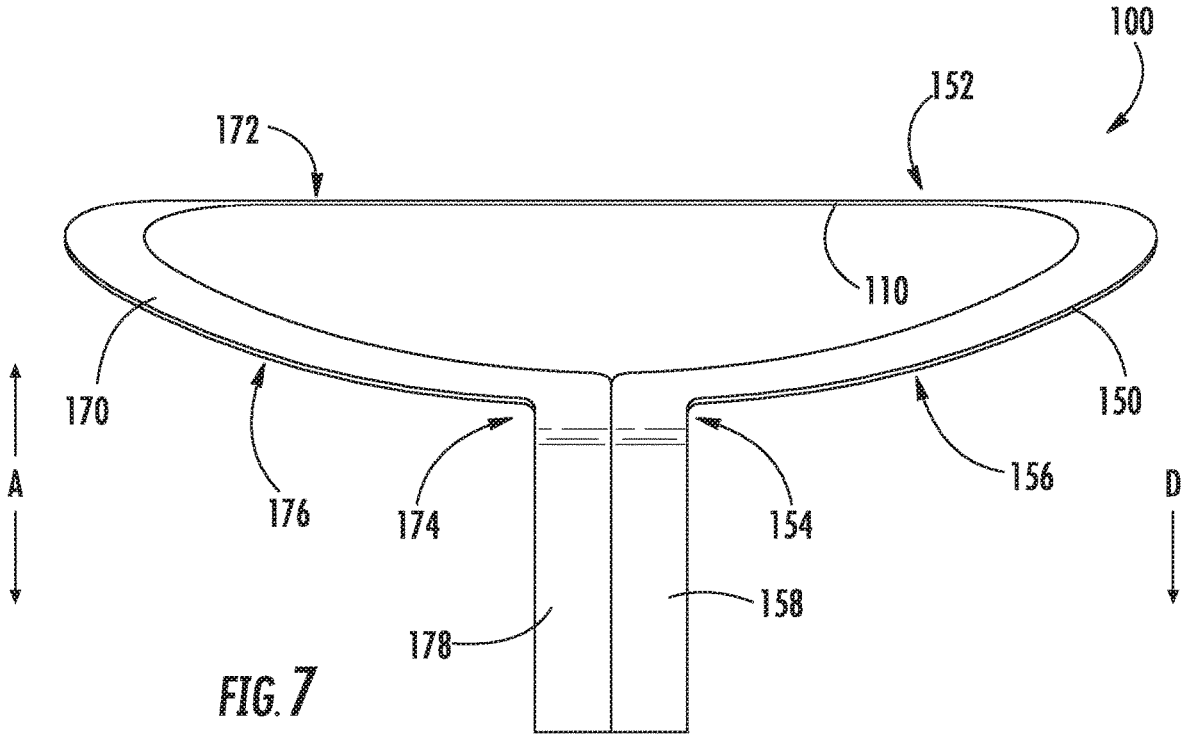
FIG. 7 provides a side elevation view of the spring bracket of FIG. 3.

FIGS. 4, 5, 6, and 7 provide various views of the spring bracket 100 of FIGS. 2 and 3. More particularly, FIG. 4 provides a perspective view of the spring bracket 100 of FIGS. 2 and 3; FIG. 5 provides a top plan view thereof; FIG. 6 provides a front elevation view thereof; and FIG. 7 provides a side elevation view thereof.

As shown in FIGS. 4 and 5, for this embodiment, mounting plate 110 extends in a plane substantially orthogonal to the axial direction A. Mounting plate 110 has a top surface 116 and an opposing bottom surface 118 (FIG. 4). A thickness of mounting plate 110 is defined between top surface 116 and bottom surface 118 along the axial direction A. Mounting plate 110 defines an opening 120 generally centered on the axial centerline AC. Opening 120 has a generally circular shape and is sized to receive temperature sensor 112 (FIGS. 2 and 3). Opening 120 also includes two rectangular-shaped cutouts on opposing ends of opening 120 to assist with mounting temperature sensor 112 to mounting plate 110 and to reduce the weight of spring bracket 100.

Mounting plate 110 extends between a first end 122 and a second end 124 along a first radial direction R1 and between a third end 126 and a fourth end 128 along a second radial direction R2. The first radial direction R1 is orthogonal to the second radial direction R2. Mounting plate 110 includes a first side 130 and a second side 132 spaced apart from first side 130 along the first radial direction R1. Mounting plate 110 also includes a third side 134 and a fourth side 136 spaced apart from third side 134 along the second radial direction R2. Third side 134 connects first side 130 with second side 132 at third end 126 of mounting plate 110 and fourth side 136 connects first side 130 with second side 132 at fourth end 128 of mounting plate 110.

As further shown in FIGS. 4 and 5, third side 134 of mounting plate 110 includes a first curved portion 138 that is convex with respect to the axial centerline AC. Similarly, fourth side 136 of mounting plate 110 includes a second curved portion 140 that is convex with respect to the axial centerline AC. First curved portion 138 defines a first space 142 and second curved portion 140 defines a second space 144. The first and second spaces 142, 144 allow for first and second arms 150, 170 to extend circumferentially into the spaces as shown. In this way, the first and second arms 150, 170 can extend a further distance along the circumferential direction C. By extending the length of first and second arms 150, 170, the force required to move spring bracket 100 along the axial direction A is decreased. In this manner, lightweight cookware or cooking utensils are better able to properly press down on the temperature sensor 112 when they are placed on electric coil 32 (FIGS. 2 and 3).

With reference still to FIGS. 4 and 5, first arm 150 extends from mounting plate 110 between a proximal end 152 and a distal end 154 and connects mounting plate 110 with support bracket 40 as shown in FIGS. 2 and 3. For this embodiment, first arm 150 extends generally from third side 134 of mounting plate 110 proximate where third end 126 and first end 122 of mounting plate 110 converge. In a similar fashion, second arm 170 extends from mounting plate 110 between a proximal end 172 and a distal end 174 and connects mounting plate 110 with support bracket 40 as shown in FIGS. 2 and 3. For this embodiment, second arm 170 extends generally from fourth side 136 of mounting plate 110 proximate where fourth end 128 and second end 124 of mounting plate 110 converge. Moreover, for this embodiment, first arm 150 extends from mounting plate 110 about radially opposite of where second arm 170 extends from mounting plate 110. "About radially opposite" means that the two noted points or objects are spaced from one another about one hundred eighty degrees (180°) along the circumferential direction C. In embodiments, where first arm 150 extends from mounting plate 110 about radially opposite of where second arm 170 extends from mounting plate 110, mounting plate 110 may travel or move more smoothly along the axial direction A and mounting plate 110 is moveable along the axial direction A with negligible or no arc (i.e., mounting plate 110 may be moveable straight along the axial direction A). In this manner, temperature sensor 112 attached to mounting plate 110 can maintain more consistent contact with a cooking utensil placed on heating element 30.

Notably, first arm 150 includes a curved portion 156 that extends about the circumferential direction C along at least a portion of first arm 150 between proximal end 152 and distal end 154 of first arm 150. For this embodiment, curved portion 156 of first arm 150 extends about mounting plate 110 along the circumferential direction C and is spaced apart from mounting plate 110 along the radial direction R as curved portion 156 of first arm 150 extends about mounting plate 110 along the circumferential direction C. Similarly, second arm 170 includes a curved portion 176 that extends about the circumferential direction C along at least a portion of second arm 170 between proximal end 172 and distal end 174 of second arm 170. For this embodiment, curved portion 176 of second arm 170 extends about mounting plate 110 along the circumferential direction C and is spaced apart from mounting plate 110 along the radial direction R as curved portion 176 of second arm 170 extends about mounting plate 110 along the circumferential direction C.

In addition, for the embodiment depicted in FIG. 5, curved portion 156 of first arm 150 extends about one hundred seventy degrees (170°) about the circumferential direction C and curved portion 176 of second arm 170 extends about one hundred seventy degrees (170°) about the circumferential direction C. Further, as shown, distal end 154 of first arm 150 is positioned within about twenty degrees (20°) of proximal end 172 of second arm 170 along the circumferential direction C and distal end 174 of the second arm 170 is positioned within about twenty degrees (20°) of proximal end 152 of first arm 150 along the circumferential direction C. By extending curved portions 156, 176 of first and second arms 150, 170 respectively about one hundred seventy degrees (170°) about the circumferential direction C, the force required to move mounting plate 110 along the axial direction A is reduced compared to arms that extends a shorter angular distance about the circumferential direction C. Less force to move mounting plate 110 along the axial direction A may allow for lightweight cooking utensils to press down properly on temperature sensor 112, as noted above.

In some alternative embodiments, curved portion 156 of first arm 150 extends greater than about one hundred thirty-five degrees (135°) about the circumferential direction C and curved portion 176 of second arm 170 extends greater than about one hundred thirty-five degrees (135°) about the circumferential direction C. In yet other embodiments, curved portion 156 of first arm 150 extends greater than about one hundred fifty-five degrees (155°) about the circumferential direction C and curved portion 176 of second arm 170 extends greater than about one hundred fifty-five degrees (155°) about the circumferential direction C. In yet other embodiments, as shown particularly in FIG. 11, curved portion 156 of first arm 150 extends greater than or equal to forty-five degrees (45°) about the circumferential direction C and curved portion 176 of second arm 170 extends greater than or equal to forty-five degrees (45°) about the circumferential direction C.

As further shown in FIG. 5, for this embodiment, curved portion 156 of first arm 150 extends along the circumferential direction C in a first circumferential direction C1 as curved portion 156 of first arm 150 extends toward distal end 154 of first arm 150 and curved portion 176 of second arm 170 extends along the circumferential direction C in the first circumferential direction C1 as curved portion 176 of second arm 170 extends toward distal end 174 of second arm 170. In this way, curved portions 156, 176 both extend in the same direction along the circumferential direction C. By extending curved portion 156 of first arm 150 and curved portion 176 of second arm 170 along the same direction along the circumferential direction C, mounting plate 110 may travel straighter along the axial direction A as opposed to moving along an arc along the axial direction A. By moving the mounting plate 110 straight upward or downward along the axial direction A, temperature sensor 112 attached thereto can better maintain contact with a cooking utensil placed on heating element 30 (FIGS. 2 and 3).

As shown in FIGS. 6 and 7, in addition to curving about the circumferential direction C, curved portion 156 of first arm 150 inclines along the axial direction A as curved portion 156 extends toward distal end 154 of first arm 150. As shown, curved portion 156 of first arm 150 inclines in the downward direction D along the axial direction A when mounting plate 110 is in a first position, or relaxed state (i.e., there is no load on electric coil 32). Likewise, curved portion 176 of second arm 170 inclines along the axial direction A as curved portion 176 extends toward distal end 174 of second arm 170. As shown in FIGS. 6 and 7, curved portion 176 of second arm 170 inclines in the downward direction D along the axial direction A when mounting plate 110 is in the first position.

As shown in FIGS. 3, 4, 6, and 7, first arm 150 includes a first tab 158 proximate its distal end 154. First tab 158 extends in a plane substantially perpendicular to the radial direction R and connects mounting plate 110 to support bracket 40. For example, first tab 158 of first arm 150 can connect with support bracket 40 at inner surface 52 of sidewall 48 of center member 42 (not completely visible in FIG. 3). In some embodiments, advantageously, first tab 158 is connected with inner surface 52 of sidewall 48 below the top edge 50 of sidewall 48 along the axial direction A. By connecting first tab 158 with sidewall 48 below top edge 50 of sidewall 48 along the axial direction A, other components of heating assembly 14 connected with spring bracket 100 (e.g., a cap covering spring bracket 100) are less likely to bottom out or restrict the axial movement of mounting plate 110 when a load is placed on electric coil 32.

Second arm 170 includes a second tab 178 proximate its distal end 174. Like first tab 158, second tab 178 extends in a plane substantially perpendicular to the radial direction R and connects mounting plate 110 to support bracket 40, e.g., in a manner as noted above with respect to first tab 158 (FIG. 3). Moreover, for this embodiment, first tab 158 connects with support bracket 40 about radially opposite of where second tab 178 connects with support bracket 40 as shown in FIG. 3. By connecting first tab 158 with support bracket 40 about radially opposite of where second tab 178 connects with support bracket 40, mounting plate 110 may travel or move more smoothly along the axial direction A. Moreover, mounting plate 110 is more likely to move straight along the axial direction A with negligible or no arc. In this manner, temperature sensor 112 attached to mounting plate 110 can maintain more consistent contact with a cooking utensil placed on heating element 30.

First and second tabs 158, 178 can connect first and second arms 150, 170 with support bracket 40 (FIGS. 2 and 3) in a number of suitable ways. For instance, first and second tabs 158, 178 can be welded, snapped, clipped, or attached to support bracket 40 with mechanical fasteners (e.g., screws or rivets), or a combination thereof. Advantageously, where first and second tabs 158, 178 are to be welded to support bracket 40, each extend a distance along the axial direction A that is sufficient to provide satisfactory welding surfaces.

As shown in FIG. 4, first arm 150 also includes a first radial portion 160 that extends along the radial direction R and connects curved portion 156 of first arm 150 with first tab 158. Second arm 170 likewise includes a second radial portion 180 that extends along the radial direction R and connects curved portion 176 of second arm 170 with second tab 178. First radial portion 160 ensures that curved portion 156 of first arm 150 is spaced from inner surface 52 of sidewall 48 of center member 42 (FIGS. 2 and 3) such that first arm 150 does not rub or engage inner surface 52 as mounting plate 110 is moved along the axial direction A. In a similar fashion, second radial portion 180 ensures that curved portion 176 of second arm 170 is spaced from inner surface 52 of sidewall 48 of center member 42 (FIGS. 2 and 3) such that second arm 170 does not rub or engage inner surface 52 as mounting plate 110 is moved along the axial direction A.

Figure 8:
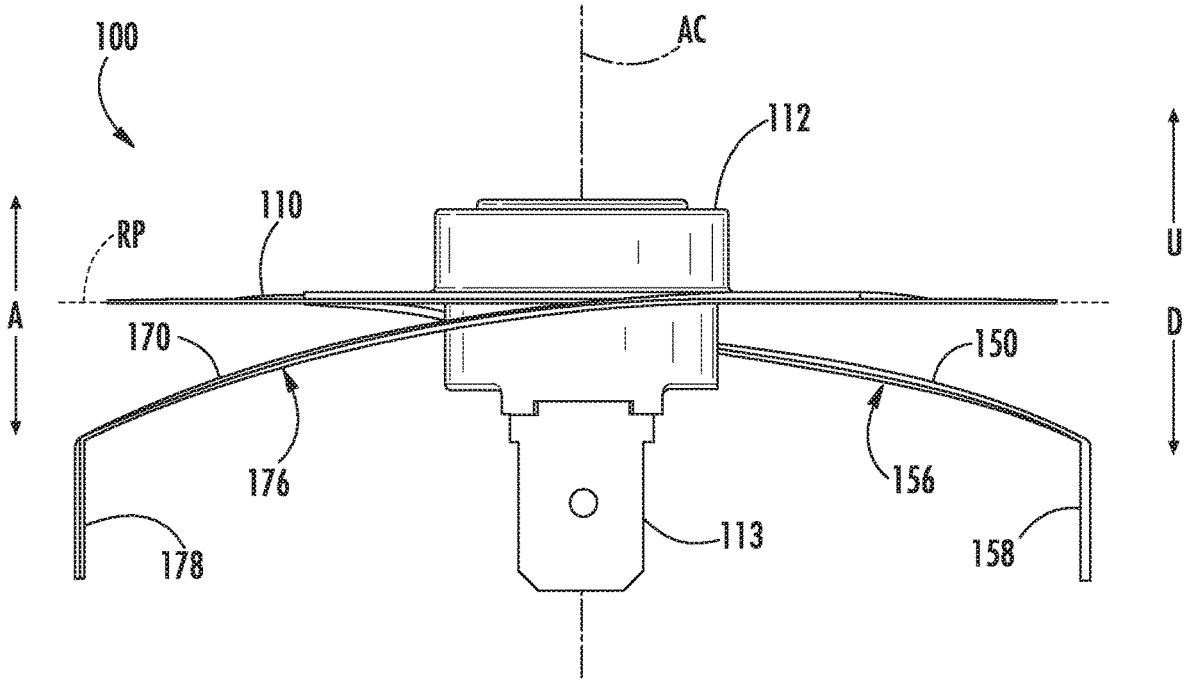
FIG. 8 provides a side view of the spring bracket of FIG. 3 with the spring bracket depicted in a first position.
Figure 9:
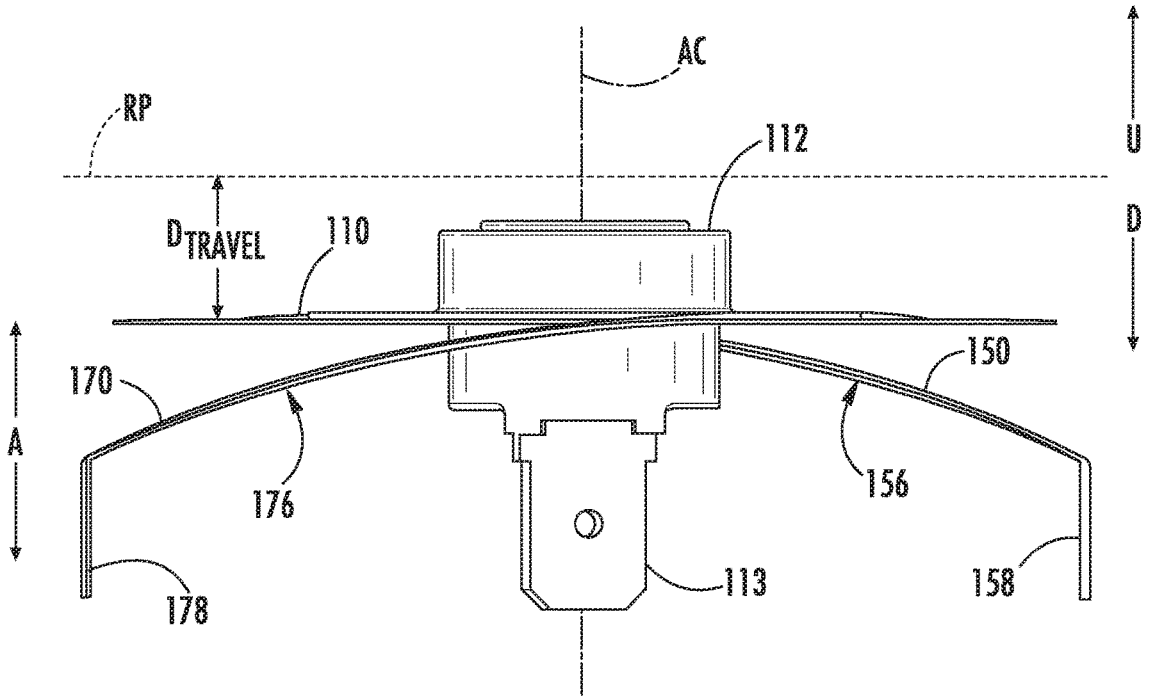
FIG. 9 provides a side view of the spring bracket of FIG. 3 with the spring bracket depicted in a second position.

FIG. 8 provides a side view of the spring bracket 100 of FIGS. 2 through 7 with the spring bracket 100 depicted in a first position and FIG. 9 provides a side view thereof with spring bracket 100 depicted in a second position. As noted above, mounting plate 110 of spring bracket 100 is moveable along the axial direction A. More particularly, mounting plate 110 is moveable along the axial direction A between the first position and the second position.

In the first position, spring bracket 100 is in a relaxed or resting state, or stated alternatively, a state in which no cooking utensil or other object is placed on electric coil 32 (FIGS. 2 and 3). When spring bracket 100 is in the first position, as shown in FIG. 8, mounting plate 110 is positioned in a plane perpendicular to the axial direction A and coplanar with a reference plane RP. Moreover, when spring bracket 100 is in the first position, the top of temperature sensor 112 protrudes further outward in the upper direction U along the axial direction A than electrical coil 32 (FIGS. 2 and 3).

When a cooking utensil is placed on electric coil 32 (FIGS. 2 and 3), temperature sensor 112 contacts the bottom surface of the cooking utensil and the cooking utensil deflects temperature sensor 112 in the downward direction D along the axial direction A. The deflection of temperature sensor 112 in the downward direction D along the axial direction A causes mounting plate 110 to move downward along the axial direction A as well, which moves mounting plate 110 from the first position toward the second position.

Elastic first and second arms 150, 170 deflect to allow mounting plate 110 to move in the downward direction D along the axial direction A. Due to the length of first and second arms 150, 170 (i.e., the curved portions 156, 176 of first and second arms 150, 170 extend greater than one hundred seventy degrees (170°) about the circumferential direction C in this embodiment), mounting plate 110 can travel or move smoothly along the axial direction A even with spring bracket 100 having a minimal vertical or axial profile. For instance, in some embodiments, mounting plate 110 can move along the axial direction A at least 0.2 inches with no more than 0.5 $lb_f$. Moreover, due to the positioning of first and second tabs 158, 178 and where the first and second arms 150, 170 extend from mounting plate 110, when mounting plate 110 is moved along the axial direction A, mounting plate 110 and temperature sensor 112 attached thereto are moved along the axial direction A with negligible or no arc. Stated alternatively, mounting plate 110 moves substantially straight along the axial direction A. In this way, temperature sensor 112 maintains better contact with the bottom surface of the cooking utensil.

In the second position, as shown in FIG. 9, spring bracket 100 is in a compressed state, or stated alternatively, a state in which cooking utensil or other object is placed on electric coil 32 (FIGS. 2 and 3). Preferably, when the spring bracket 100 is in the second position, the top of sensor 112, the bottom of the cooking utensil, and the top surface of electric coil 32 are all positioned in the same plane that is perpendicular to the axial direction A. As further shown in FIG. 9, when spring bracket 100 is in the second position, mounting plate 110 has moved in the downward direction D along the axial direction A such that mounting plate 110 is no longer coplanar with the reference plane RP. As shown, mounting plate 110 has traveled a distance $D_{TRAVEL}$. Moreover, as shown, electrical connector 113 of temperature sensor 112 is shown slightly twisted about the axial centerline AC in FIG. 9 compared to its position in FIG. 8. This is due to the deflection and twisting of the first and second arms 150, 170 when a cooking utensil applies a load on spring bracket 100. After the cooking utensil is removed from electric coil 32, first and second arms 150, 170 return mounting plate 110 in an upward direction U along the axial direction A to the first position.

Figure 10:
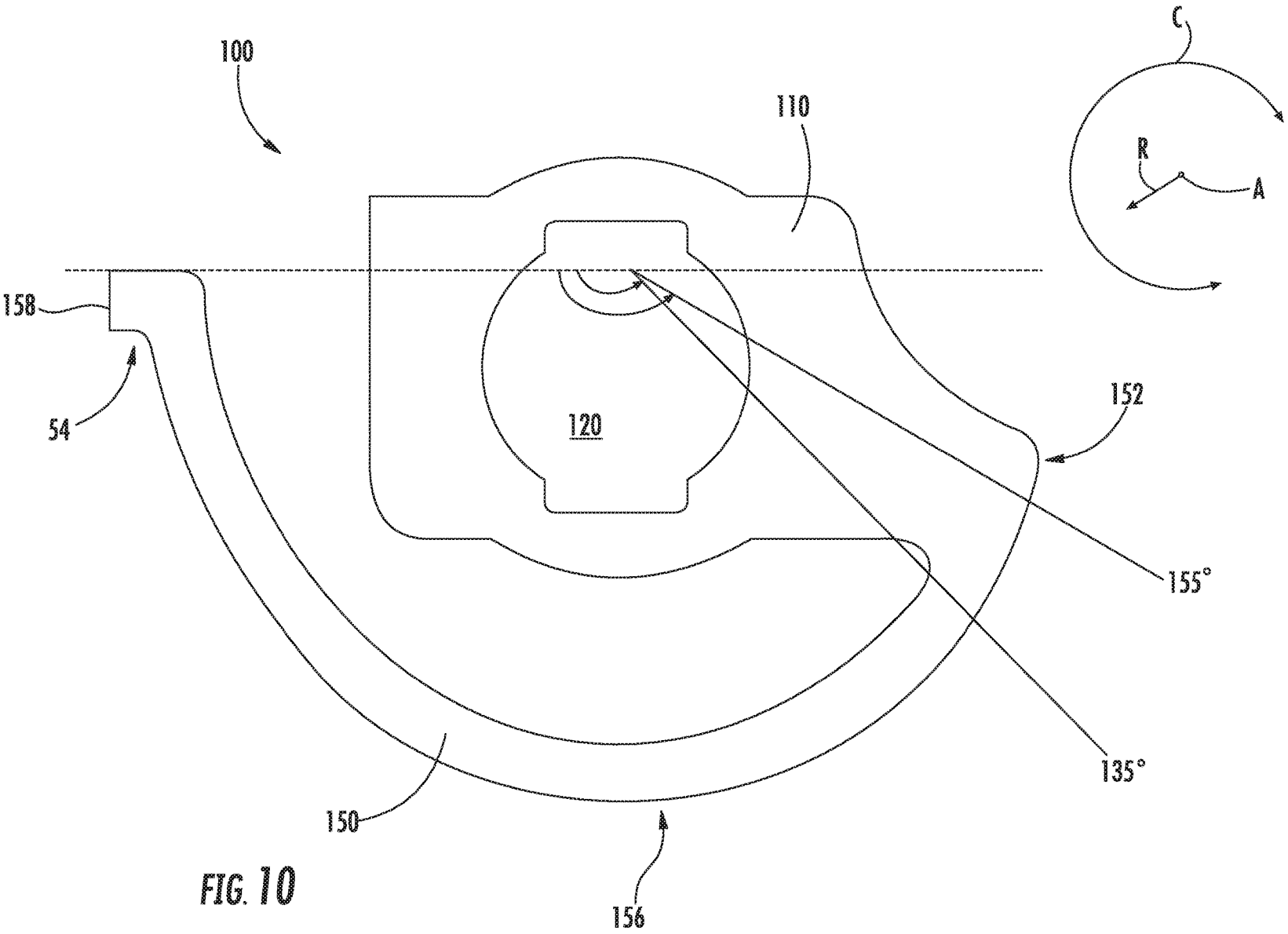
FIG. 10 provides a top view of another exemplary spring bracket according to an exemplary embodiment of the present disclosure.

FIG. 10 provides a perspective view of another exemplary spring bracket 100 according to an exemplary embodiment of the present disclosure. The exemplary spring bracket 100 of FIG. 10 is configured in a similar manner as the spring bracket of FIGS. 2 through 9, and accordingly, the same or similar numbering refers to the same or similar part. By contrast with the spring bracket of FIGS. 2 through 9, spring bracket 100 of FIG. 10 includes a single arm extending greater than about one hundred thirty-five degrees (135°) about mounting plate 110 along the circumferential direction C. For this embodiment, the single arm is denoted herein as first arm 150. More particularly, for this embodiment, single arm extends greater than one hundred fifty-five degrees (155°) about mounting plate 110 along the circumferential direction C.

In some embodiments, to prevent or limit mounting plate 110 from traveling along an arc as it moves along the axial direction A, one or more suspension members can connect mounting plate 110 to a stationary component of cooktop appliance 10 (FIG. 1). In this way, the moment created about the single connection point (i.e., where first tab 158 connects with sidewall 48 of support bracket 40 (FIGS. 2 and 3)) when mounting plate 110 is moved along the axial direction A can be counteracted. Thus, mounting plate 110 can move straighter along the axial direction A, which ultimately leads to temperature sensor 112 maintaining more consistent contact with the cooking utensil.

Figure 11:
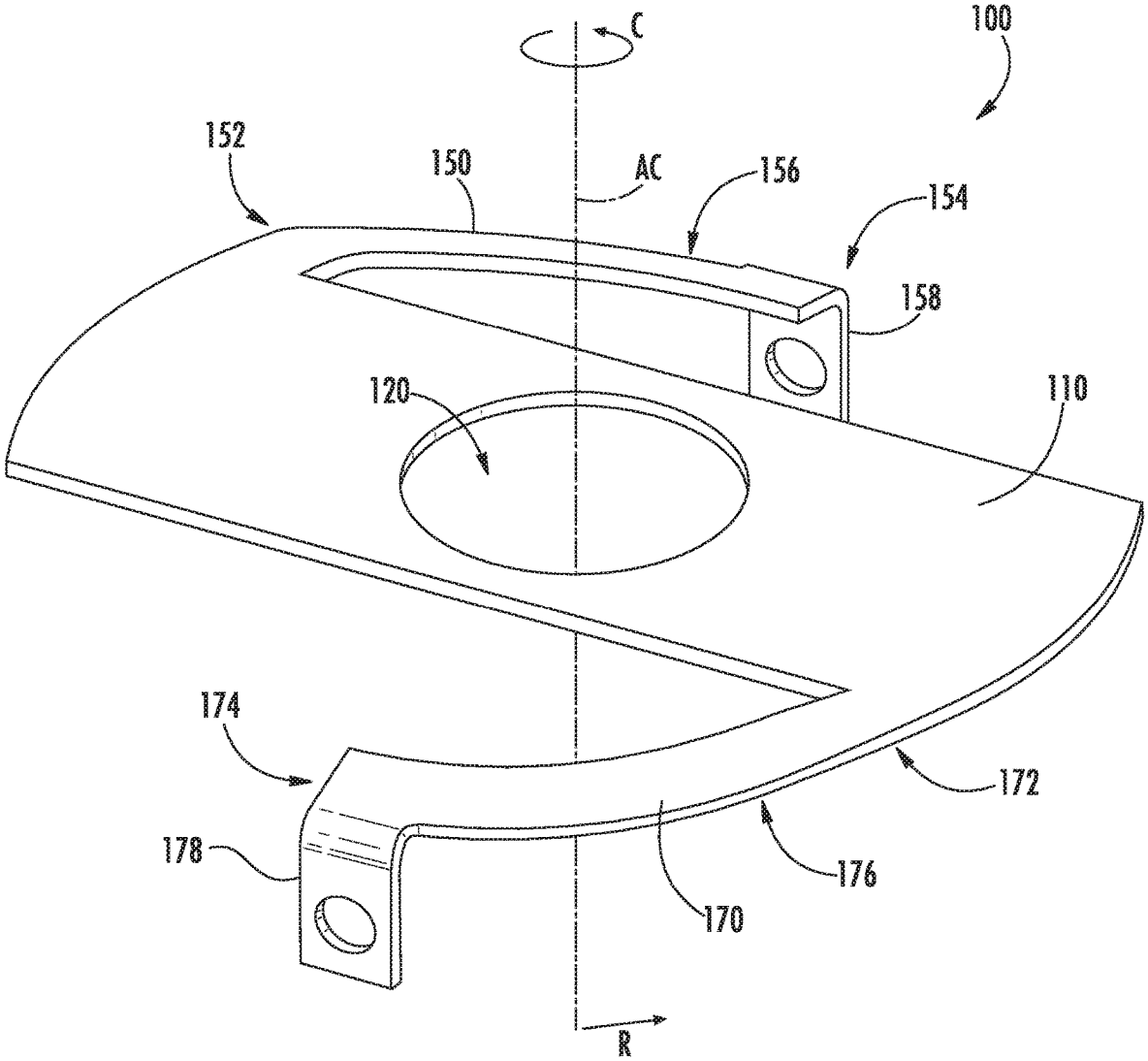
FIG. 11 provides a perspective view of yet another exemplary spring bracket according to an exemplary embodiment of the present disclosure.

FIG. 11 provides a perspective view of yet another exemplary spring bracket 100 according to an exemplary embodiment of the present disclosure. The exemplary spring bracket 100 of FIG. 11 is configured in a similar manner as the spring bracket of FIGS. 2 through 9, and accordingly, the same or similar numbering refers to the same or similar part. By contrast with the spring bracket of FIGS. 2 through 9, first arm 150 of spring bracket 100 of FIG. 11 extends greater than or equal to forty-five degrees (45°) about the circumferential direction C and second arm 170 extends greater than or equal to forty-five degrees (45°) about the circumferential direction C.

Figure 12:
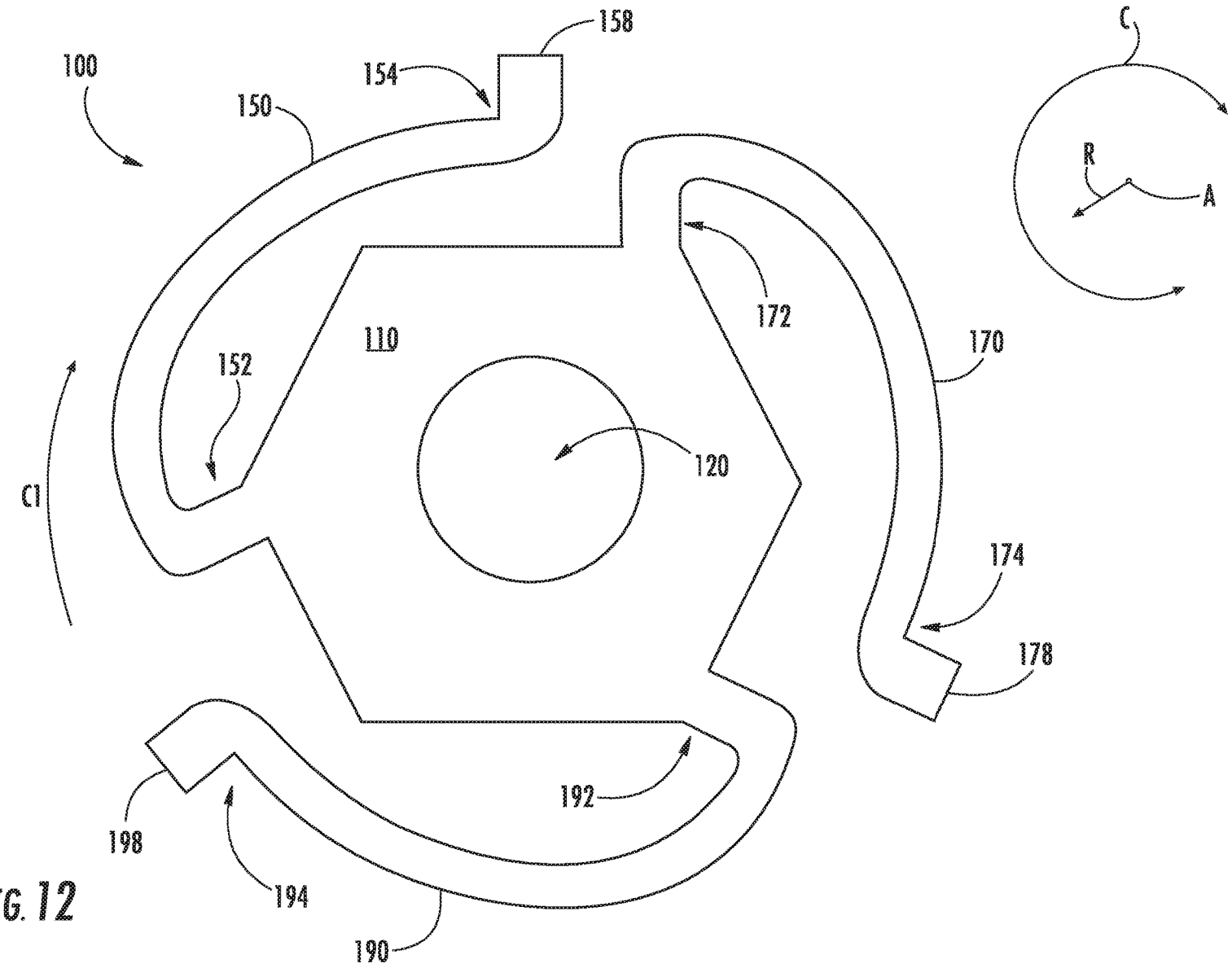
FIG. 12 provides a perspective view of yet another exemplary spring bracket according to an exemplary embodiment of the present disclosure.

FIG. 12 provides a perspective view of yet another exemplary spring bracket 100 according to an exemplary embodiment of the present disclosure. The exemplary spring bracket 100 of FIG. 12 is configured in a similar manner as the spring bracket of FIGS. 2 through 9, and accordingly, the same or similar numbering refers to the same or similar part. By contrast with the spring bracket of FIGS. 2 through 9, spring bracket 100 of FIG. 12 includes three arms extending from mounting plate 110 at substantially equal intervals along the circumferential direction C. That is, first arm 150, second arm 170, and third arm 190 of spring bracket 100 extend from mounting plate 110 at substantially equal angular distances from one another. Moreover, for this embodiment, first tab 158 of first arm 150, second tab 178 of second arm 170, and third tab 198 of third arm 190 are spaced apart from one another at substantially equal intervals along the circumferential direction C such that they can each be connected with support bracket 40 (FIGS. 2 and 3) at substantially equal intervals. By equally spacing where the arms extend from mounting plate 110 and where the tabs connect with support bracket 40, mounting plate 110 may travel straighter along the axial direction A as opposed to moving along an arc. In this way, temperature sensor 112 (not depicted in FIG. 12) can better maintain contact with the cooking utensil placed on heating element.

As further shown in FIG. 12, for this embodiment, first arm 150, second arm 170, and third arm 190 each extend from mounting plate 110 to the their respective distal ends 154, 174, 194 in a first circumferential direction C1 along the circumferential direction C. Stated differently, each arm extends along the circumferential direction C in the same direction. In addition, curved portion 156 of first arm 150, curved portion 176 of second arm 170, and curved portion 196 of third arm 190 each extend greater than ninety degrees (90°) about the circumferential direction C. Furthermore, as shown in FIG. 12, in this embodiment, mounting plate 110 has a hexagon shape.

As further depicted in FIG. 12, first arm 150 extends outward from mounting plate 110 along the radial direction R at proximal end 152 of first arm 150, second arm 170 extends outward from mounting plate 110 along the radial direction R at proximal end 172 of second arm 170, and third arm 190 extends outward from mounting plate 110 along the radial direction R at proximal end 192 of third arm 190. By extending each arm from mounting plate 110 along the radial direction R, the curved portions of each arm is spaced apart from mounting plate 110 along the radial direction R, which reduces the risk that mounting plate 110 will bottom out or contact the arms as mounting plate 110 moves along the axial direction A.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spring bracket for a cooktop appliance, the cooktop appliance comprising a heating element and a support bracket for supporting the heating element, the spring bracket defining an axial direction, a radial direction, and a circumferential direction, the spring bracket comprising:

a mounting plate moveable along the axial direction;

a first arm extending from the mounting plate between a proximal end and a distal end and connecting the mounting plate with the support bracket, wherein the first arm comprises a curved portion that extends about the circumferential direction along at least a portion of the first arm between the proximal end and the distal end of the first arm; and a second arm extending from the mounting plate between a proximal end and a distal end and connecting the mounting plate with the support bracket, wherein the second arm comprises a curved portion that extends about the circumferential direction along at least a portion of the second arm between the proximal end and the distal end of the second arm;

wherein the mounting plate is moveable between a first position and a second position along the axial direction, wherein the mounting plate is in a relaxed state in the first position and the mounting plate is in a compressed state in the second position, and wherein the curved portion of the first arm inclines along the axial direction as the curved portion extends toward the distal end of the first arm and the second arm inclines along the axial direction as the curved portion extends toward the distal end of the second arm when the mounting plate is in the first position.

2. The spring bracket of claim 1, wherein the first arm extends outward from the mounting plate along the radial direction at the proximal end of the first arm and the second arm extends outward from the mounting plate along the radial direction at the proximal end of the second arm.

3. The spring bracket of claim 1, wherein the curved portions of the first and second arms incline in a downward direction along the axial direction when the mounting plate is in the first position.

4. The spring bracket of claim 1, wherein the curved portion of the first arm extends along the circumferential direction in a first circumferential direction as the curved portion of the first arm extends toward the distal end of the first arm and the curved portion of the second arm extends along the circumferential direction in the first circumferential direction as the curved portion of the second arm extends toward the distal end of the second arm.

5. The spring bracket of claim 1, wherein the first arm extends from the mounting plate about radially opposite of where the second arm extends from the mounting plate.

6. The spring bracket of claim 1, wherein the curved portion of the first arm is spaced apart from the mounting plate along the radial direction and the curved portion of the second arm is spaced apart from the mounting plate along the radial direction.

7. The spring bracket of claim 1, wherein the first arm comprises a first tab proximate the distal end of the first arm, the first tab connecting the mounting plate to the support bracket, and wherein the second arm comprises a second tab proximate the distal end of the second arm, the second tab connecting the mounting plate to the support bracket, and wherein the first tab connects with the support bracket about radially opposite of where the second tab connects with the support bracket.

8. The spring bracket of claim 1, wherein the first arm extends greater than or equal to forty-five degrees (45°) about the circumferential direction and the second arm extends greater than or equal to forty-five degrees (45°) about the circumferential direction.

9. The spring bracket of claim 1, wherein the first arm extends greater than about one hundred thirty-five degrees (135°) about the circumferential direction and the second arm extends greater than about one hundred thirty-five degrees (135°) about the circumferential direction.

10. The spring bracket of claim 1, wherein the distal end of the first arm is positioned within about forty-five degrees (45°) of the proximal end of the second arm along the circumferential direction and wherein the distal end of the second arm is positioned within about forty-five degrees (45°) of the proximal end of the first arm along the circumferential direction.

11. The spring bracket of claim 1, wherein the mounting plate extends in a plane substantially orthogonal to the axial direction and wherein a temperature sensor is mounted thereto.

12. The spring bracket of claim 1, wherein the mounting plate is moveable along the axial direction by at least 0.2 inches with equal to or less than 0.5 lbf.

13. A cooktop appliance, comprising:

a heating element;

a support bracket for supporting the heating element;

a spring bracket defining an axial direction, a radial direction, and a circumferential direction, the spring bracket comprising:

a mounting plate moveable along the axial direction in response to a load placed on the heating element and having a temperature sensor mounted thereto; and one or more arms extending from the mounting plate between a proximal end and a distal end and connecting the mounting plate with the support bracket, wherein the one or more arms extend about the mounting plate along the circumferential direction and are spaced apart from the mounting plate along the radial direction as the one more arms extend about the mounting plate;

wherein the one or more arms include a single arm extending greater than about one hundred thirty-five degrees (135°) about the mounting plate along the circumferential direction.

14. The cooktop appliance of claim 13, wherein the one or more arms include at least three arms connected with the support bracket at substantially equal intervals along the circumferential direction.

15. The cooktop appliance of claim 14, wherein the at least three arms each extend from the mounting plate to their respective distal ends in a first circumferential direction along the circumferential direction.

16. The cooktop appliance of claim 13, wherein the one or more arms include a first arm that extends greater than about one hundred fifty degrees (150°) about the mounting plate along the circumferential direction and a second arm that extends greater than about one hundred fifty degrees (150°) about the mounting plate along the circumferential direction; and wherein the distal end of the first arm is positioned within about twenty degrees (20°) of the proximal end of the second arm along the circumferential direction and wherein the distal end of the second arm is positioned within about twenty degrees (20°) of the proximal end of the first arm along the circumferential direction.

17. The cooktop appliance of claim 13, wherein the heating element defines a center, and wherein the temperature sensor mounted to the mounting plate is positioned substantially in the center of the heating element.

18. A spring bracket for a cooktop appliance, the cooktop appliance comprising a heating element and a support bracket for supporting the heating element, the spring bracket defining an axial direction, a radial direction, and a circumferential direction, the spring bracket comprising:

a mounting plate moveable along the axial direction;

a first arm extending from the mounting plate between a proximal end and a distal end and connecting the mounting plate with the support bracket, wherein the first arm comprises a curved portion that extends about the circumferential direction along at least a portion of the first arm between the proximal end and the distal end of the first arm; and a second arm extending from the mounting plate between a proximal end and a distal end and connecting the mounting plate with the support bracket, wherein the second arm comprises a curved portion that extends about the circumferential direction along at least a portion of the second arm between the proximal end and the distal end of the second arm;

wherein the curved portion of the first arm extends along the circumferential direction in a first circumferential direction as the curved portion of the first arm extends toward the distal end of the first arm and the curved portion of the second arm extends along the circumferential direction in the first circumferential direction as the curved portion of the second arm extends toward the distal end of the second arm.

* * * * *